US012331538B1

(12) United States Patent
Hoese et al.

(10) Patent No.: US 12,331,538 B1
(45) Date of Patent: Jun. 17, 2025

(54) AWNING SUPPORT PROTECTION SYSTEM

(71) Applicants: John Hoese, Ramsey, MN (US); Cheree Hoese, Ramsey, MN (US)

(72) Inventors: John Hoese, Ramsey, MN (US); Cheree Hoese, Ramsey, MN (US)

( * ) Notice: Subject to any disclaimer, the term of this patent is extended or adjusted under 35 U.S.C. 154(b) by 191 days.

(21) Appl. No.: 18/130,068

(22) Filed: Apr. 3, 2023

Related U.S. Application Data

(60) Provisional application No. 63/334,999, filed on Apr. 26, 2022.

(51) Int. Cl.
*E04H 15/08* (2006.01)
*E04H 15/58* (2006.01)
*E04H 15/60* (2006.01)

(52) U.S. Cl.
CPC ..... *E04H 15/08* (2013.01); *E04H 15/58* (2013.01); *E04H 15/60* (2013.01)

(58) Field of Classification Search
CPC ..... E04H 15/08; E04H 15/58; E04H 15/60; E04H 15/32
USPC ..... 428/99
See application file for complete search history.

(56) References Cited

U.S. PATENT DOCUMENTS 5,246,052 A * 9/1993 Homan ..... E04F 10/0614 160/46
5,860,440 A * 1/1999 Murray ..... B60P 3/343 160/67
6,488,069 B1 * 12/2002 Mashaw ..... E04F 10/0681 160/63
8,574,701 B2 * 11/2013 Fox ..... B60R 19/02 428/188
9,125,467 B2 * 9/2015 Randel ..... E04H 15/32
11,814,859 B2 * 11/2023 Razzano ..... E04H 15/58
2004/0231251 A1 * 11/2004 Ward ..... H01Q 1/1242 52/40
2011/0281059 A1 * 11/2011 Toy ..... B65D 81/03 428/100
2016/0024813 A1 * 1/2016 Koyl ..... E04H 12/2269 135/120.1

* cited by examiner

*Primary Examiner* — Noah Chandler Hawk
(74) *Attorney, Agent, or Firm* — Spencer Fane LLP; Michael Bondi

(57) ABSTRACT

A protected awning support system that is used in conjunction with a recreational vehicle. The protected awning support system includes an awning, an awning support and an awning support cover. The awning has a proximal edge and a distal edge. The proximal awning edge is attached to the recreational vehicle. When in an open configuration, the awning extends from the recreational vehicle and is supported with the awning support that extends between the awning and the recreational vehicle. The awning support cover includes an elongated cover body and at least one fixation device. The elongated cover body is at least partially fabricated from a padded material. The at least one fixation device is attached to the elongated cover body. When the elongated cover body is positioned over a surface of the awning support, the at least one fixation device retains the elongated cover body on the awning support.

18 Claims, 5 Drawing Sheets

AWNING SUPPORT PROTECTION SYSTEM

REFERENCE TO RELATED APPLICATION

This application claims priority to Provisional Applic. No. 63/334,999, filed on Apr. 26, 2023, the contents of which are incorporated herein by reference.

FIELD OF THE INVENTION

The invention relates generally to awnings. More particularly, the invention relates to an awning support cover for an awning that is attached to a recreational vehicle.

BACKGROUND OF THE INVENTION

Awnings are a popular accessory for recreational vehicles such as campers and travel trailers because the awnings enable an area adjacent to the recreational vehicle to be shielded such as from sun or rain.

The awning typically includes an elongated cover material and a support frame that maintains the elongated cover in a desired position with respect to the recreational vehicle. The awning support frame is typically oriented at an angled configuration with respect to the elongated cover such that an end of the awning support frame that is attached to the recreational vehicle is spaced apart from the part of the elongated cover that is attached to the recreational vehicle.

While this configuration provides stability to the awning, in many instances the awning support frame is located sufficiently close to a ground surface such that there is the potential for persons who are near to the recreational vehicle to contact the awning support frame and such contact could injure the person.

SUMMARY OF THE INVENTION

An embodiment of the invention is directed to a protected awning support system that is used in conjunction with a recreational vehicle. The protected awning support system includes an awning, an awning support and an awning support cover. The awning has a proximal edge and a distal edge. The proximal awning edge is attached to the recreational vehicle. The awning is movable between a closed configuration and an open configuration. When in the open configuration, the awning extends from the recreational vehicle. The awning support extends between the awning and the recreational vehicle to maintain the awning in the open configuration. The awning support cover includes an elongated cover body and at least one fixation device. The elongated cover body is at least partially fabricated from a padded material. The at least one fixation device is attached to the elongated cover body. When the elongated cover body is positioned over a surface of the awning support, the at least one fixation device retains the elongated cover body on the awning support.

Another embodiment of the invention is directed to an awning support protection system for protecting an awning support that maintains an awning that extends from a recreational vehicle in an opening configuration. The awning support protection system includes an elongated cover body and at least one fixation device. The elongated cover body is at least partially fabricated from a padded material. The elongated cover body includes a first cover section and a second cover section. The first cover section has a first width. The second cover section has a second width. The first cover section is attached to the second cover section with a seam. The seam has a length that is less than the first width and the second width. The at least one fixation device is attached to the elongated cover body. When the elongated cover body is positioned over a surface of the awning support, the at least one fixation device retains the elongated cover body on the awning support.

Another embodiment of the invention is directed to a method of protecting an awning support. An awning is provided that is operably attached to a recreational vehicle. The awning has a proximal edge and a distal edge. The proximal awning edge is attached to the recreational vehicle. The awning is movable between a closed configuration and an open configuration. When in the open configuration, the awning extends from the recreational vehicle. An awning support is provided that extends between the awning and the recreational vehicle to maintain the awning in the open configuration. An awning support cover is provided that includes an elongated cover body and at least one fixation device. The elongated cover body is at least partially fabricated from a padded material. The at least one fixation device is attached to the elongated cover body. When the awning is in the open configuration, the elongated cover body is positioned over a surface of the awning support. The awning support cover is retained in a position that at least partially covers the awning support using the at least one fixation device.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 4:
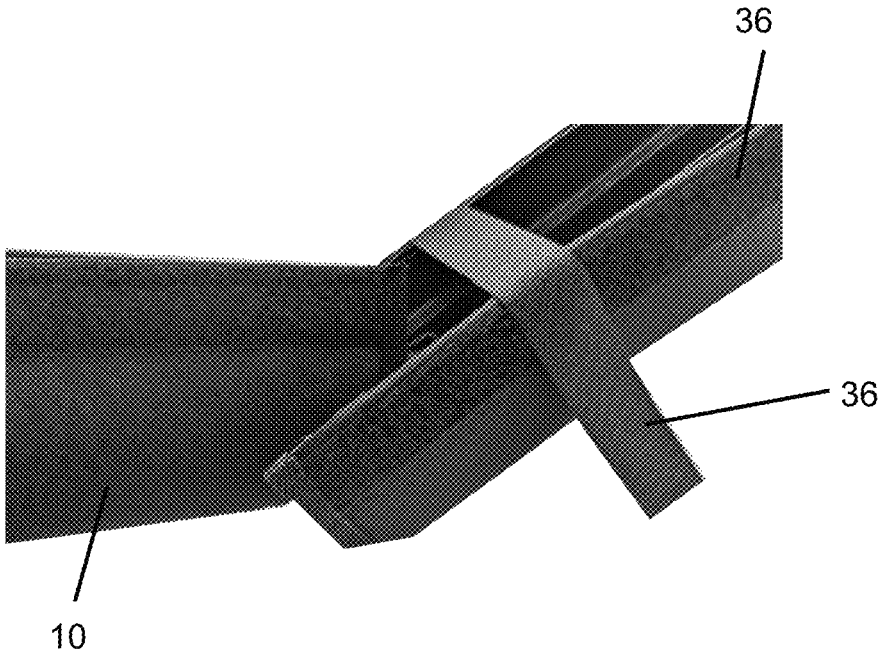
FIG. 4 is a perspective view of the awning support cover used in conjunction with the awning support.
Figure 5:
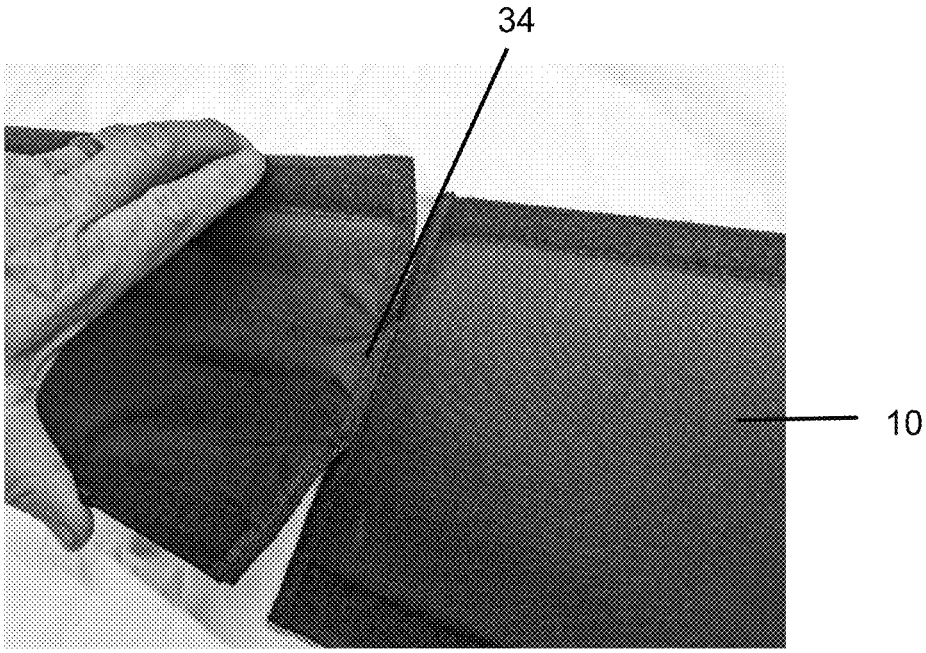
FIG. 5 is a perspective view of a connection between a first cover section and a second cover section.

An embodiment of the invention is directed to an awning support cover as illustrated at 10 in the drawings. The awning support cover 10 at least partially covers an awning support 20 that is used in conjunction with an awning 22 that is attached to a recreational vehicle 12, such as illustrated in FIGS. 3-5, where the awning 22 is in an open configuration.

The awning support 20 maintains the awning 22 in the open configuration that extends away from the recreational vehicle 12 in a generally horizontal orientation. When it is desired to move the recreational vehicle 12, the awning 22 is moved to a closed configuration that is generally adjacent to a side surface of the recreational vehicle 12.

Figure 3:
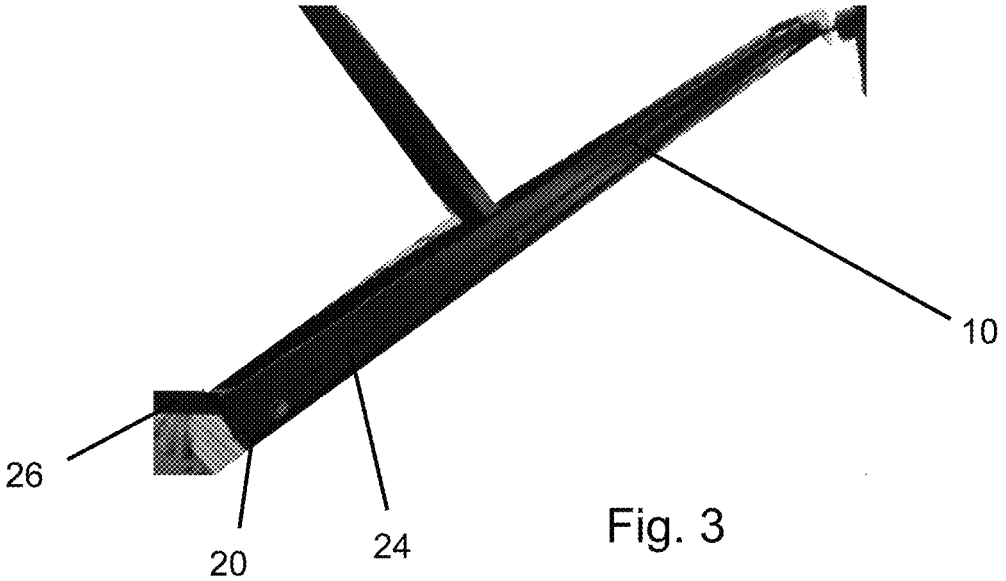
FIG. 3 is a perspective view of an awning support when an awning is in an open configuration.

In certain embodiments, the awning support 20 includes a first support section 24 and a second support section 26 that are pivotally attached to each other, as illustrated in FIG. 3. The first support section 24 and the second support section 26 pivot with respect to each other when the awning 22 is moved between the open configuration and the closed configuration.

The awning support 20 includes a lower support surface, a first side support surface and a second side support surface. The lower support surface is located on a lower surface of the awning support when the awning 22 is in the open configuration. The first side support surface and the second side support surface are located along opposite edges of the lower support surface.

Figure 1:
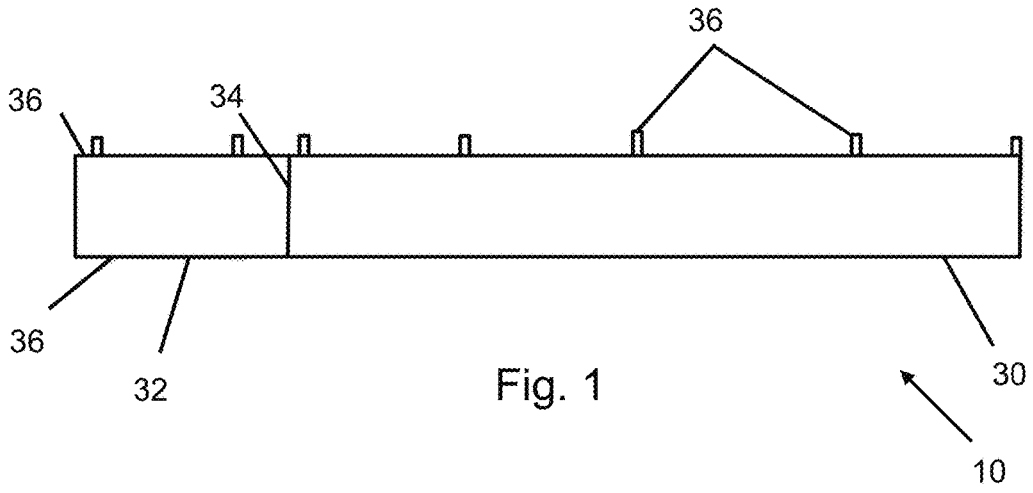
FIG. 1 is a top view of an awning support cover according to an embedment of the invention.
Figure 2:
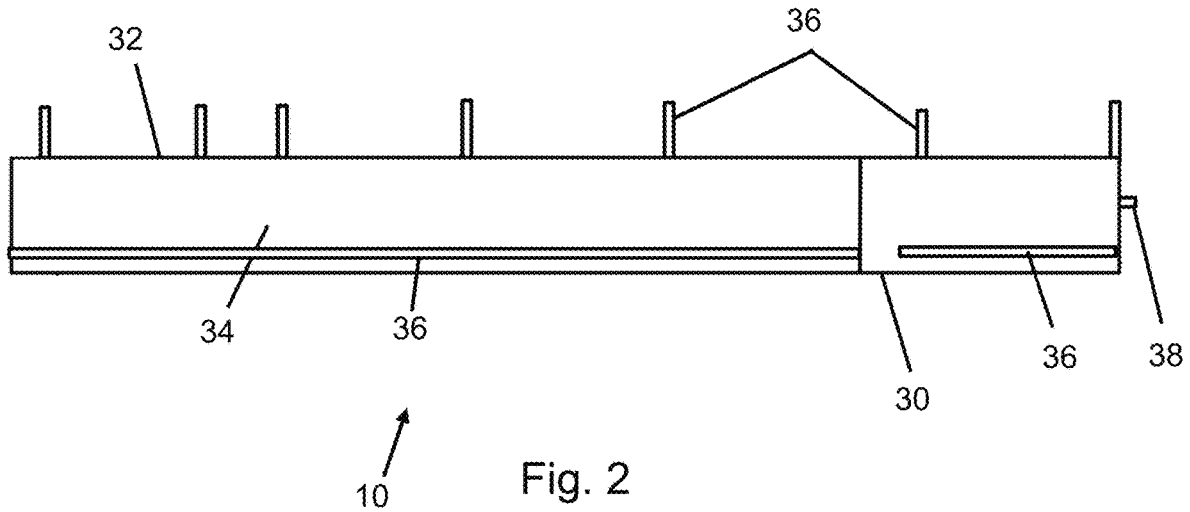
FIG. 2 is a bottom view of the awning support cover.

The awning support cover 10 may generally include an elongated body as illustrated in FIG. 1 that is formed with a length so that the awning support cover 10 covers at least a portion of the awning support 20 on which it is desired to use the awning support cover 10. While in certain embodiments, the awning support cover 10 covers substantially all of the awning support 20, in other embodiments, the awning support cover 10 only covers a portion of the awning support 20 that the person is likely to come into contact with such as a lower surface of the awning support 20.

The awning support cover 10 is formed with a width that is sufficiently large to cover at least a portion of a profile of the awning support 20. In certain embodiments, the width of the awning support cover 10 is wider than a lower surface of the awning support 20. In other embodiments, the awning support cover 10 extends over at least a portion of sides of the awning support 20. In still other embodiments, the awning support cover 10 substantially covers the sides of the awning support 20.

The awning support cover 10 may generally include a first cover section 30 and a second cover section 32. When the awning support cover 10 is attached to the awning support 20, the first cover section 30 may be generally straight and the second cover section 32 may be generally straight.

When the awning support cover 10 is provided with a seam 34 proximate the intersection of the first cover section 30 and the second cover section 32, the seam 34 is positioned proximate a bend in the awning support 20.

As illustrated in FIG. 5, the seam 34 may be attached along less than an entire width of the awning support cover 10. In certain embodiments, the attachment of the seam 34 is only about ⅓ of the width of the awning support cover 10 and the attachment of the seam 34 is approximately intermediate between opposite sides of the awning support cover 10. As such, a length of the seam 34 is less than a length of the first cover section and the second cover section as illustrated in FIG. 5

The awning support cover 10 is fabricated from a padded material that is in contrast from the rigid material such as metal from which the awning support 20 is fabricated. As used herein, padded means that the material deforms in response to a force being placed thereon but when the force is discontinued, the padded material returns to its original shape and/or thickness. The awning support cover 10 thereby protects a person from injury when a portion of the person's body comes into contact with the awning support 20.

The padded material may be at least partially covered with a protective material that resists damage from contact and/or degradation from exposure to the sun. In certain embodiments, the protective material substantially covers an outer surface of the awning support cover 10. Examples of materials that are suitable for use as the protective material include polyester, coated polyester, nylon, cloth, cotton, plastic, vinyl and canvas.

An outer surface of the awning support cover 10 may at least partially be fabricated with a color and/or a design that enhances the ability of persons to see the awning support cover 10 and thereby reduces the potential of the person contacting the awning support 20 because even though the awning support cover 10 reduces the potential of the person being injured by contact with the awning support 20, the person may still experience pain from contact with the awning support cover 10.

In one embodiment, the outer surface of the awning support cover 10 is fabricated with a color that contrasts from the color of the awning support 20 and/or the color of the recreational vehicle 12 to which the retractable awning 22 is mounted. Alternatively or additionally, at least a portion of the awning support cover 10 is fabricated with a high visibility color such as yellow. The color may be fluorescent. It is also possible for at least a portion of the awning support cover 10 to be fabricated from a reflective material.

In certain embodiments, the awning support cover 10 is removably attached to the awning support 20. A fixation device 36 is used to secure the awning support cover 10. An example of one suitable technique for removably attaching the awning support cover 10 are hook and loop fastener (VELCRO) strips 36 that extend from one side edge of the awning support cover 10 to the opposite sides of the awning support cover 10 as illustrated in FIG. 1. A person of skill in the art will appreciate that a variety of other mechanisms may be used, examples of which include snaps, buttons, zippers, elastic, rings, clips, buckles, cable ties, hooks and eyes, grommets, magnets, toggles, tape and bungee cords.

The fixation device 36 may be fabricated with an elongated configuration. The fixation devices may be provided in mating pairs and one of the pair may be mounted generally transverse to the second of the pair. Such a configuration facilitates the awning support cover 10 being used in conjunction with awning supports having a variety of differently sized profiles.

There are a plurality of the fixation devices 36 that are provided in a spaced-apart configuration along a length of the awning support cover 10. The number of fixation devices 36 may depend on factors such as the length of the awning support cover 10. In certain embodiments, there are between about 5 and 10 of the fixation devices 36.

In use, the fixation devices 36 are positioned in an unattached configuration and the awning support cover 10 is wrapped at least partially around the awning support as illustrated in FIG. 4. The fixation devices 36 along one edge of the awning support cover 10 are attached to the other side to thereby secure the awning support cover 10 to the awning support 20.

The configuration of the fixation devices 36 enables the awning support cover 10 to be quickly removed from the awning support 20 such as when it is desired to move the awning 22 to the retracted configuration.

The awning support cover 10 substantially covers the lower support surface of the awning support 20. In other embodiments, the awning support cover 10 substantially covers the lower support surface, the first side support surface and the second side support surface.

Figure 7:
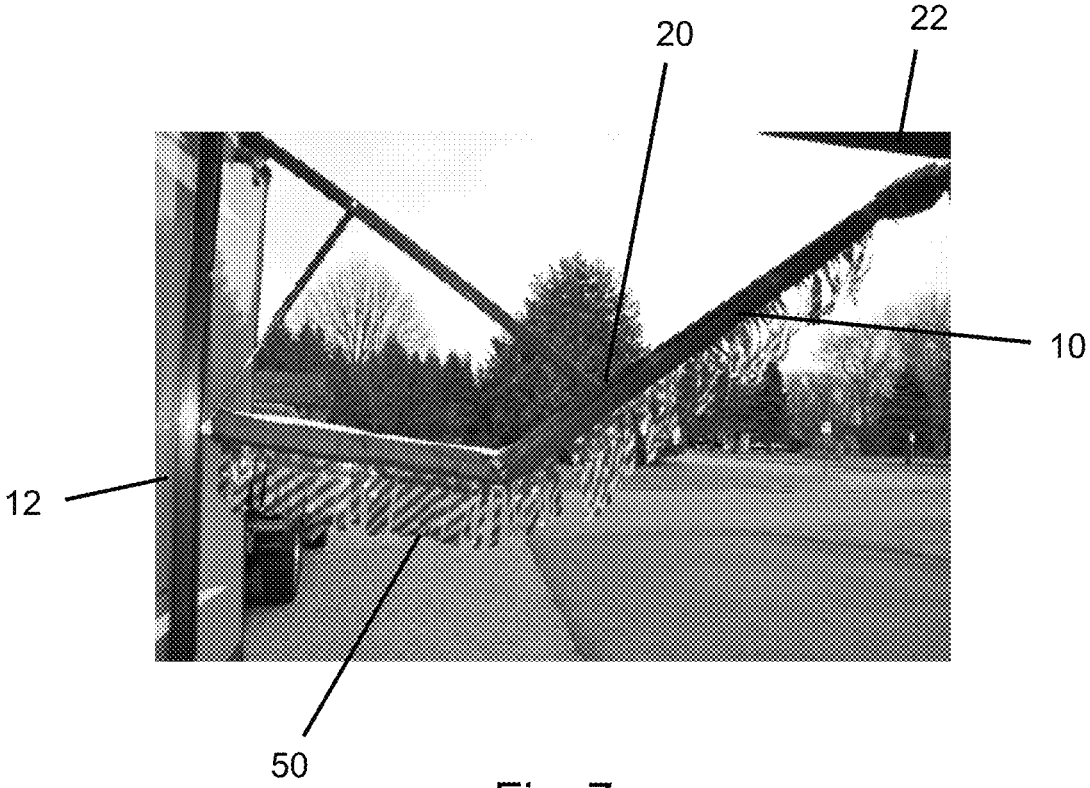
FIG. 7 is a side view of the awning support cover used in conjunction with the awning support where an enhanced warning material is attached to the awning support cover.

Another embodiment of the invention is directed to the awning support cover 10 being used for attaching an enhanced warning material 50 to the awning support 20, as illustrated in FIG. 7.

The enhanced warning material 50 may be fabricated from a flexible material that readily bends in response to contact. The enhanced warning material 50 may be formed in a plurality of narrow strips. Fabricating the enhanced warning material with this configuration may enable the strips to independently move in response to wind and the movement of the strips may further enhance the ability of persons to see the enhanced warning material 50.

At least a portion of the enhanced warning material 50 may be fabricated from a metallic or reflective material that reflects light that impinges upon the enhanced warning material 50, which further enhances the ability of persons to see the enhanced warning material 50.

In one embodiment, the enhanced warning material 50 extends a distance from the awning support 20. Using such a configuration, if the person contacts a distal end of the enhanced warning material 50, the person will be made aware of the proximity of the harder structure of the awning support cover 10 and the awning support 20 and through such awareness, the person will be encouraged to not continue to move towards the awning support 20.

The distance that the enhanced warning material 50 extends from the awning support 20 may be greater than a thickness of the awning support 20. In certain embodiments, the enhanced warning material 50 has a length that is greater than about 5 times the thickness of the awning support 20.

In certain embodiments, the enhanced warning material 50 is removably attached to the awning support cover 10. An example of one suitable technique for removably attaching the enhanced warning material 50 to the awning support cover 10 is hook and loop fastener (not shown), which is available under the trademark VELCRO.

It is also possible for the enhanced warning material 50 to be used in conjunction with celebrating events such as holidays. For example, providing the enhanced warning material 50 in the colors red, white and blue may be used when celebrating Independence Day in the US. These colors may be provided in a configuration of stars and/or stripes that are similar to a US flag. Still other examples include pennants, flags, bunting, streamers, banners, string pennants, lights and other lightweight objects.

Figure 6:
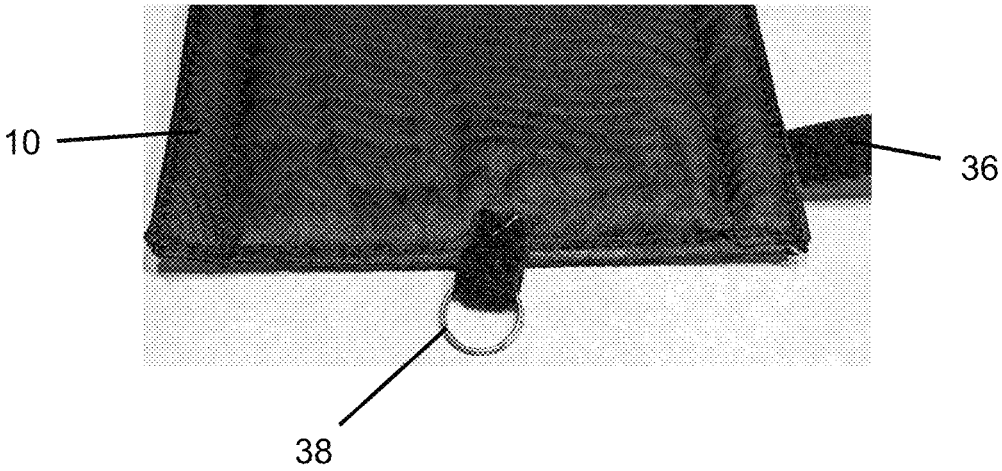
FIG. 6 is an enlarged top view of an end of the awning support cover in FIG. 2.

Another embodiment of the invention is directed to the awning support cover 10 having an attachment loop 38 attached to the end of the awning support cover 10 at the upper most end therefore, as illustrated in FIG. 6. In certain embodiments, the attachment loop 38 may be fabricated from a metallic or plastic material that is attached to the awning support cover 10 such as by using a flexible strap material. It is also possible to removably attach the attachment loop 38 to the awning support cover 10 using other mechanisms such as hook and loop fasteners.

Figure 8:
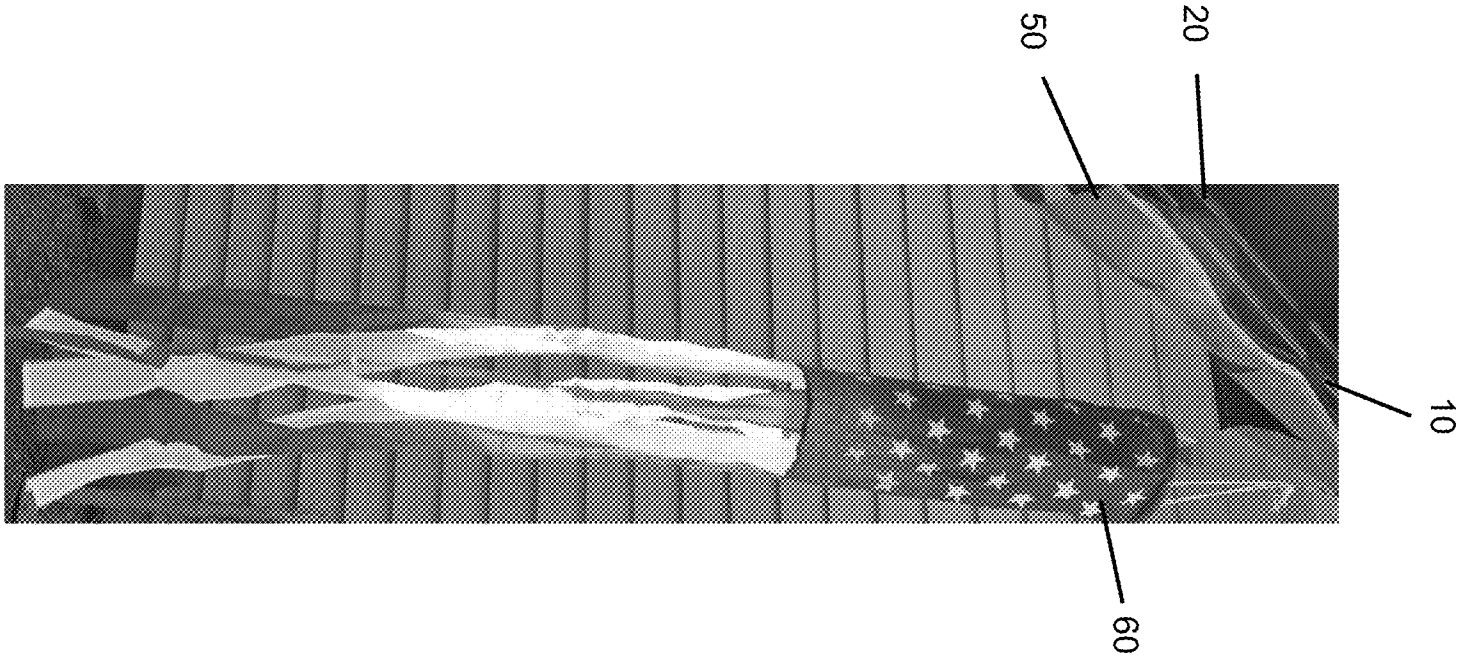
FIG. 8 is a perspective view of the awning support cover used in conjunction with the awning support where a decorative hanging object is attached to the awning support cover.

The attachment loop 38 may be used to hang a lightweight decoration 60 such as illustrated in FIG. 8. In addition to further drawing attention to the awning support 20, the lightweight decoration 60 further enhances the aesthetics of the retractable awning 22.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A protected awning support system that is used in conjunction with a recreational vehicle, wherein the protected awning support system comprises:

an awning having a proximal edge and a distal edge, wherein the proximal awning edge is attached to the recreational vehicle, wherein the awning is movable between a closed configuration and an open configuration and wherein when in the open configuration, the awning extends from the recreational vehicle;

an awning support that extends between the awning and the recreational vehicle to maintain the awning in the open configuration, wherein the awning support comprises a first awning support section and a second awning support section; and an awning support cover comprising:

an elongated cover body that is at least partially fabricated from a padded material, wherein the elongated cover body comprises a first cover section and a second cover section; and at least one fixation device attached to the elongated cover body, wherein when the elongated cover body is positioned over a surface of the awning support, the at least one fixation device retains the elongated cover body on the awning support, wherein when the awning support cover is retained on the awning support, the first cover section is positioned over the first awning support section and the second cover section is positioned over the second awning support section.

2. The protected awning support system of claim 1, wherein the at least one fixation device comprises at least one of a hook and loop fastener, a snap and a clip and wherein the at least one fixation device comprises a plurality of fixation devices that are mounted to the elongated cover body in a spaced-apart configuration.

3. The protected awning support system of claim 1, wherein the awning support comprises a lower support surface and wherein when the awning support cover is retained on the awning support, the awning support cover substantially covers the lower support surface.

4. The protected awning support system of claim 1, wherein the awning support comprises a lower support surface, a first side support surface and a second side support surface, wherein the first side support surface and the second side support surface both extend from the lower support surface, wherein when the awning support cover is retained on the awning support, the elongated cover body substantially covers the lower support surface, the first side support surface and the second side support surface.

5. The protected awning support system of claim 1, wherein the first cover section has a first width, wherein the second cover section has a second width, wherein the first cover section is attached to second cover section with a seam and wherein the seam has a length that is less than the first width and the second width.

6. The protected awning support system of claim 1, and further comprising an enhanced warning material that extends from at least part of the awning support cover, wherein the enhanced warning material is fabricated from at least one of readily bendable strips and a reflective material.

7. The protected awning support system of claim 1, and further comprising an attachment loop attached to the elongated cover body and a lightweight decoration secured to the attachment loop.

8. An awning support protection system for protecting an awning support that maintains an awning that extends from a recreational vehicle in an opening configuration, wherein the awning support protection system comprises:

an elongated cover body that is at least partially fabricated from a padded material, wherein the elongated cover body comprises a first cover section and a second cover section, wherein the first cover section has a first width, wherein the second cover section has a second width, wherein the first cover section is attached to second cover section with a seam and wherein the seam has a length that is less than the first width and the second width; and at least one fixation device attached to the elongated cover body, wherein when the elongated cover body is positioned over a surface of the awning support, the at least one fixation device retains the elongated cover body on the awning support.

9. The awning support protection system of claim 8, wherein the at least one fixation device comprises at least one of a hook and loop fastener, a snap and a clip and wherein the at least one fixation device comprises a plurality of fixation devices that are mounted to the elongated cover body in a spaced-apart configuration.

10. The awning support protection system of claim 8, wherein the awning support comprises a lower support surface having a width and wherein the elongated cover body has a width that is greater than the width of the lower support surface.

11. The awning support protection system of claim 8, wherein the awning support comprises a lower support surface, a first side support surface and a second side support surface, wherein the first side support surface and the second side support surface both extend from the lower support surface, wherein when the awning support cover is retained on the awning support, the elongated cover body substantially covers the lower support surface, the first side support surface and the second side support surface.

12. The awning support protection system of claim 8, wherein the awning support comprises a first awning support section and a second awning support section and wherein when the awning support cover is retained on the awning support, the first cover section is positioned over the first awning support section and the second cover section is positioned over the second awning support section.

13. The awning support protection system of claim 8, and further comprising an enhanced warning material that extends from at least part of the awning support cover, wherein the enhanced warning material is fabricated from at least one of readily bendable strips and a reflective material.

14. A method of protecting an awning support comprising:

providing an awning operably attached to a recreational vehicle, wherein the awning has a proximal edge and a distal edge, wherein the proximal awning edge is attached to the recreational vehicle, wherein the awning is movable between a closed configuration and an open configuration and wherein when in the open configuration, the awning extends from the recreational vehicle;

providing an awning support that extends between the awning and the recreational vehicle to maintain the awning in the open configuration, wherein the awning support comprises a first awning support section and a second awning support section;

providing an awning support cover comprising an elongated cover body and at least one fixation device, wherein the elongated cover body comprises a first cover section and a second cover section, wherein the elongated cover body is at least partially fabricated from a padded material, wherein the at least one fixation device is attached to the elongated cover body;

when the awning is in the open configuration, positioning the elongated cover body over a surface of the awning support; and retaining the awning support cover in a position that at least partially covers the awning support using the at least one fixation device, wherein when the awning support cover is retained on the awning support, the first cover section is positioned over the first awning support section and the second cover section is positioned over the second awning support section.

15. The method of protecting the awning support of claim 14, wherein the at least one fixation device comprises at least one of a hook and loop fastener, a snap and a clip and wherein the at least one fixation device comprises a plurality of fixation devices that are mounted to the elongated cover body in a spaced-apart configuration.

16. The method of protecting the awning support of claim 14, wherein the awning support comprises a lower support surface and wherein the method further comprises substantially covering the lower support surface with the awning support cover.

17. The method of protecting the awning support of claim 14, wherein the awning support comprises a lower support surface, a first side support surface and a second side support surface, wherein the first side support surface and the second side support surface both extend from the lower support surface and wherein the method further comprises substantially covering the lower support surface, the first side support surface and the second side support surface when the awning support cover is retained on the awning support.

18. The method of protecting the awning support of claim 14, wherein the first cover section has a first width, wherein the second cover section has a second width, wherein the first cover section is attached to second cover section with a seam and wherein the seam has a length that is less than the first width and the second width.

* * * * *